US006155078A

United States Patent [19]

Miyashita et al.

[11] Patent Number: 6,155,078

[45] Date of Patent: Dec. 5, 2000

[54] AIR DISTILLATION APPARATUS AND AIR DISTILLATION METHOD

[75] Inventors: Kazuhiko Miyashita; Tadatoshi Aida, both of Tokyo, Japan

[73] Assignee: L'Air Liquide, Societe Anonyme pour l'Etude et l'Exploitation des Procedes Georges Claude, Paris Cedex, France

[21] Appl. No.: 09/136,965

[22] Filed: Aug. 20, 1998

[30] Foreign Application Priority Data

Aug. 20, 1997 [JP] Japan ..... 9-223498
Dec. 4, 1997 [JP] Japan ..... 9-333937

[51] Int. Cl.[7] ..... F25J 1/00

[52] U.S. Cl. ..... 62/643; 62/905; 62/913

[58] Field of Search ..... 62/913, 656, 643, 62/905

[56] References Cited

U.S. PATENT DOCUMENTS 2,864,757 12/1958 Balcar et al. ..... 62/913
4,526,595 7/1985 McNeil ..... 62/913
4,617,040 10/1986 Yoshino ..... 62/656
4,732,595 3/1988 Yoshino ..... 62/656
5,355,680 10/1994 Darredeau et al. ..... 62/913
5,505,052 4/1996 Ekins et al. ..... 62/913

*Primary Examiner*—Ronald Capossela
*Attorney, Agent, or Firm*—Young & Thompson

[57] ABSTRACT

In an air distillation apparatus having a main heat exchanger 7 for cooling down feed air, a rectification column 9S comprising a rectifying portion 13 for separating the thus-cooled feed air to an oxygen-enriched component and a nitrogen component and a condenser 35S for partially condensing the latter, and a liquid nitrogen storage tank 31S for supplying liquid nitrogen by way of a supply valve V3, and a transport route 18 for transporting an oxygen-enriched liquid flowing down from said rectifying portion 13 to the bottom into said condenser 35S, the said oxygen-enriched liquid is not reserved at the bottom of the column. Control means include a liquid level detection means for detecting the height of a liquid level of said oxygen-enriched liquid reserved in said condenser 35S; and a control means LIC for controlling the opening degree of the supply valve V3, on the basis of the output therefrom, so that the liquid level of said oxygen-enriched liquid reserved in said condenser is kept almost at a set level.

10 Claims, 4 Drawing Sheets

AIR DISTILLATION APPARATUS AND AIR DISTILLATION METHOD

FIELD OF THE INVENTION

The present invention relates to an air distillation apparatus and air distillation method, in which feed air is separated by utilizing a rectification column containing trays or structured packings.

BACKGROUND OF THE INVENTION

Known air distillation apparatus comprise a main heat exchanger for cooling down feed air which has been compressed, cooled and freed of impurities; a rectification column comprising a rectifying portion for separating the thus-cooled feed air introduced here to an oxygen-enriched component and a nitrogen component, and a condenser for partially condensing the separated nitrogen component to provide a reflux liquid; a liquid nitrogen storage tank for supplying liquid nitrogen to said rectification column as a part of the reflux liquid and a source of cold by way of a supply valve; and a cold supply route for supplying cold to said main heat exchanger.

In such a unit, nitrogen gas is mainly produced, for instance, by compressing air taken in from the atmospheric air by a compressor, cooling down said air by a refrigerator, and removing impurities such as carbon dioxide and moisture therefrom by an adsorption device or the like, and then cooling down this feed air nearly to its liquefying point by utilizing cold of waste gas in a main heat exchanger, and introducing the thus-cooled feed air to a rectification column, separating it to an oxygen-enriched component and a nitrogen component in the rectifying portion of said rectification column, and partially condensing the separated nitrogen component in a condenser to provide a reflux liquid, and on the other hand supplying liquid nitrogen from a liquid nitrogen storage tank to said rectification column as a part of the reflux liquid and a source of refrigeration by way of a supply valve.

Although an oxygen-enriched liquid reserved in the bottom of the rectification column is transported as refrigeration to the condenser and reserved in the same condenser, in the aforementioned unit, it is required, for stable rectification in the rectifying portion even when the consumption of a product gas varies, that the height of a liquid level of said oxygen-enriched liquid reserved in the condenser is made almost constant so as to make the condensing capacity (the cooling capacity) of said condenser placed in the upper part of the same rectifying portion or outside of the rectification column almost constant.

Known methods of controlling the liquid level in a condenser comprise:

(1) In J-A-61046747, there is proposed a method of regulating the amount of liquid nitrogen assist to be supplied as a part of a reflux liquid and a source of refrigeration, in dependence on liquid level in a condenser, without regulating the amount of liquefied air reserved in the bottom of a rectification column and introduced into the condenser.

(2) In J-A-64054187, there is proposed a method of detecting the pressure of product nitrogen gas, and regulating the amount of liquefied air (an oxygen-enriched component) reserved in the bottom of a rectification column introduced into a condenser and the amount of the product nitrogen gas. This method causes the liquid level in the condenser to vary, thereby coping with the variation in the consumption of product nitrogen gas, but it is not possible to keep the liquid level of cold in the condenser almost constant so that the condensing capacity (the cooling capacity) of the condenser is made almost constant.

In method of J-A-61046747, however, the flow rate of liquefied air in a conduit from the bottom of a rectification column to a condenser seldom varies, even if the supply of liquid nitrogen supplied as a part of a reflux liquid and a source of cold is regulated because liquefied air is reserved in the bottom of a rectification column, and as a result, control gets impossible of being followed up to the change of the liquid level of cold in the condenser and hence the constancy of rectification can not be kept by keeping the liquid level of cold in the condenser almost constant. Even when the supply of liquid nitrogen is regulated by the control of the method of J-A-61046747 and the amount of liquid air flowing down to the bottom of the rectification column is changed by virtue of this regulation, the reserve amount of liquefied air reserved in the bottom of the rectification column merely varies and the flow rate thereof in said route seldom vary, and hence cold even in an amount only of compensating for the change of the liquid level of cold in the condenser is not supplied, because the flow rate of liquefied air in a conduit leading it from the bottom of a rectification column to a condenser will be determined depending on the pressure in the bottom of the rectification column, the pressure in the condenser or the opening degree of a valve provided in the conduit between them. As a result, control becomes impossible of being followed up to the change of the liquid level in the condenser, and in an extreme case, the condenser becomes empty or completely full.

In a case where oxygen gas is produced, on the other hand, a duplex rectification column is generally used comprising: a medium-pressure rectification column having a medium-pressure rectifying portion for separating feed air which has been cooled as in the aforementioned case, introduced here, to an oxygen-enriched component and a nitrogen component, and a condenser for condensing the separated nitrogen component to provide a reflux liquid; a low-pressure rectification column having a low-pressure rectifying portion for using as a reflux liquid a part of the reflux liquid in said medium-pressure rectification column introduced here by way of an expansion valve, and separating the oxygen-enriched component introduced here from the bottom of said medium-pressure rectification column to an oxygen component and a nitrogen component, and a cold reserving portion of said condenser of allowing said oxygen component to flow in from the same low-pressure rectifying portion; a liquid oxygen storage tank for supplying liquid oxygen to the same cold reserving portion by way of a supply valve; and a cold supply route for supplying cold to a main heat exchanger. Even in the condenser of said medium-pressure rectification column, however, there will be easily caused problems similar to the aforementioned case.

SUMMARY OF THE INVENTION

It is an object of the present invention to provide an air distillation apparatus and air distillation method in which the stability of rectification can be enhanced because control can be quickly followed up to the change of the liquid level in a condenser by regulating the supply of a liquefied product or the like.

In order to achieve this purpose, there is provided an air liquefaction separator comprising: a main heat exchanger for cooling down feed air which has been compressed, cooled and freed of impurities nearly to its liquefying point; a rectification column comprising a rectifying portion for separating the thus-cooled feed air introduced here to an oxygen-enriched component and a nitrogen component, and a condenser for partially condensing the separated nitrogen component to provide a reflux liquid; a liquid nitrogen storage tank for supplying liquid nitrogen to said rectification column as a part of the reflux liquid and a source of cold by way of a supply valve; and a cold supply route for supplying cold to said main heat exchanger, characterized by comprising: a transport route for transporting an oxygen-enriched liquid flowing down from said rectifying portion to the bottom of said rectification column into said condenser as cold, without reserving said oxygen-enriched liquid in the bottom of said rectification column; a liquid level detection means for detecting the height of a liquid level of said oxygen-enriched liquid reserved in said condenser; and a control means for controlling the opening degree of the supply valve for said liquid nitrogen, on the basis of an output from said liquid level detection means, so that the liquid level of said oxygen-enriched liquid reserved in said condenser is kept almost at a set level.

There is consequently no liquid level at the bottom of the column.

The invention also comprises an air distillation method, which comprising: cooling down feed air which has been compressed, cooled and freed of impurities nearly to its liquefying point by a main heat exchanger; introducing the thus-cooled feed air to a rectification column; separating it to an oxygen-enriched component and a nitrogen component within the rectifying portion in said rectification column, and partially condensing the separated nitrogen component by a condenser to provide a reflux liquid; and on the other hand supplying liquid nitrogen from a liquid nitrogen storage tank to said rectification column as a part of the reflux liquid and a source of cold by way of a supply valve; thereby producing product nitrogen gas, characterized by comprising: transporting an oxygen-enriched liquid flowing down from said rectifying portion to the bottom of said rectification column into said condenser as cold, without reserving said oxygen-enriched liquid in the bottom of said rectification column; detecting the height of a liquid level of said oxygen-enriched liquid reserved in said condenser by a liquid level detection means; and controlling the opening degree of the supply valve for said liquid nitrogen, on the basis of an output from said liquid level detection means, so that the liquid level of said oxygen-enriched liquid reserved in said condenser is kept almost at a set level.

The third aspect of the present invention resides in: an air distillation unit comprising: a main heat exchanger for cooling down feed air which has been compressed, cooled and freed of impurities nearly to its liquefying point; a medium-pressure rectification column comprising a medium-pressure rectifying portion for separating the thus-cooled feed air introduced here to an oxygen-enriched component and a nitrogen component, and a condenser for condensing the separated nitrogen component to provide a reflux liquid; a low-pressure rectification column comprising a low-pressure rectifying portion, where a part of the reflux liquid of said medium-pressure rectification column introduced here by way of an expansion valve is used as a reflux liquid, for separating an oxygen-enriched component introduced here from the bottom of said medium-pressure rectification column to an oxygen component and a nitrogen component, and a cold reserving portion of said condenser for allowing said oxygen component flowing therein from said low-pressure rectifying portion; a liquid oxygen storage tank for supplying liquid oxygen to said cold reserving portion by way of a supply valve; and a cold supply route for supplying cold to said main heat exchanger, characterized by comprising: a transport route for leading an oxygen-enriched component from the bottom of said medium-pressure rectification column to said low-pressure rectification column, which is used as a transport route for transporting an oxygen-enriched liquid flowing down to said bottom, without reserving said oxygen-enriched liquid in said bottom; a liquid level detection means for detecting the height of a liquid level of said cold reserved in said cold reserving portion; and a control means for controlling the opening degree of the supply valve for said liquid oxygen, on the basis of an output from said liquid level detection means, so that the liquid level of said cold reserved in said cold reserving portion is kept almost at a set level.

The fourth aspect of the present invention resides in: an air distillation method, which comprising: cooling down feed air which has been compressed, cooled and freed of impurities nearly to its liquefying point by a main heat exchanger; introducing the thus-cooled feed air to a medium-pressure rectification column; separating it to an oxygen-enriched component and a nitrogen component within the medium-pressure rectifying portion in said medium-pressure rectification column, and condensing the separated nitrogen component by a condenser to provide a reflux liquid; and on the other hand introducing a part of said reflux liquid to the low-pressure rectifying portion as a reflux liquid by way of an expansion valve, and introducing thereto an oxygen-enriched component from the bottom of said medium-pressure rectification column; separating them to an oxygen component and a nitrogen component in said low-pressure rectifying portion; and causing said oxygen component from said low-pressure rectifying portion to flow into a cold reserving portion of said condenser, and supplying liquid oxygen from a liquid oxygen storage tank to the cold reserving portion by way of a supply valve, thereby producing product nitrogen gas, characterized by comprising: transporting an oxygen-enriched liquid flowing down from said medium-pressure rectifying portion to the bottom of said medium-pressure rectification column into said low-pressure rectifying portion, without reserving said oxygen-enriched liquid in the bottom of said medium-pressure rectification column, and rectifying said oxygen-enriched liquid here, and thereafter introducing it to the cold reserving portion of said condenser as cold; and detecting the height of a liquid level of said cold reserved in said cold reserving portion by a liquid level detection means, and controlling the opening degree of the supply valve for said liquid oxygen, on the basis of an output from said liquid level detection means, so that the liquid level of said cold reserved in said cold reserving portion is kept almost at a set level.

According to the first aspect of the present invention, there is provided a transport route for transporting an oxygen-enriched liquid flowing down from said rectifying portion to the bottom of said rectification column into said condenser as cold, without reserving said oxygen-enriched liquid in the bottom of said rectification column. By controlling the opening degree of the supply valve for said liquid nitrogen by the control means on the basis of an output from a liquid level detection means for detecting the height of a liquid level of said oxygen-enriched liquid reserved in said condenser, accordingly, the amount of the oxygen-enriched component flowing down to the bottom of the rectification column is regulated and it is immediately transported to the condenser, whereby the liquid level of cold in the condenser can be quickly regulated.

As a result, control can be quickly followed up to the change of the liquid level of cold in the condenser by regulating the supply of the liquefied product, and hence there can be provided an air liquefaction separator in which the constancy of rectification can be enhanced.

According to the second aspect of the present invention, an oxygen-enriched liquid flowing down from said rectifying portion to the bottom of said rectification column is transported into said condenser as cold, without reserving said oxygen-enriched liquid in the bottom of said rectification column, and the height of a liquid level of said oxygen-enriched liquid reserved in said condenser is detected by a liquid level detection means, and the opening degree of the supply valve for said liquid nitrogen is controlled on the basis of the output from said liquid level detection means, so that the liquid level of said oxygen-enriched liquid stored in said condenser is kept almost at a set level. Accordingly, the same effect as mentioned above can be obtained.

As a result, control can be quickly followed up to the change of the liquid level of cold in the condenser by regulating the supply of the liquefied product, and hence there can be provided an air liquefaction separator in which the constancy of rectification can be enhanced.

According to the third aspect of the present invention, a transport route for leading an oxygen-enriched component from the bottom of said medium-pressure rectification column to said low-pressure rectification column is used as a transport route for transporting an oxygen-enriched liquid flowing down to said bottom, without reserving said oxygen-enriched liquid in said bottom. Accordingly, the oxygen-enriched liquid flowing down to said bottom can be immediately led to the low-pressure rectification column. similarly to the aforementioned case, and hence the constancy of rectification can be further enhanced in answer to the change of the supply of cold into the duplex rectification column, by controlling the opening degree of the supply valve for said liquid oxygen by the control means.

As a result, control can be quickly followed up to the change of the liquid level of cold in the condenser by regulating the supply of the liquid oxygen, and hence there can be provided an air liquefaction separator in which the constancy of rectification can be enhanced.

According to the fourth aspect of the present invention, an oxygen-enriched liquid flowing down from said medium-pressure rectifying portion to the bottom of said medium-pressure rectification column is transported into said low-pressure rectifying portion, without reserving said oxygen-enriched liquid in the bottom of said medium-pressure rectification column, and said oxygen-enriched liquid is rectified here and thereafter it is introduced to a cold reserving portion of said condenser as cold, and the height of a liquid level of said cold reserved in said cold reserving portion is detected by a liquid level detection means, and the opening degree of the supply valve for said liquid oxygen is controlled on the basis of an output from said liquid level detection means, so that the liquid level of said cold reserved in said cold reserving portion is kept almost at a set level. Accordingly, the same effect as mentioned above can be obtained.

As a result, control can be quickly followed up to the change of the liquid level of cold in the condenser by regulating the supply of the liquid oxygen, and hence there can be provided an air liquefaction separator in which the constancy of rectification can be enhanced.

BRIEF DESCRIPTION OF THE DRAWINGS

Now referring to the drawings, embodiments of the present invention will be described. Since the present invention comprises the first to fourth aspects, as mentioned above, it will be described separately to a first embodiment corresponding to the first aspect and the second aspect and a second embodiment corresponding to the third aspect and the fourth aspect.

DETAILED DESCRIPTION OF THE INVENTION

Figure 1:
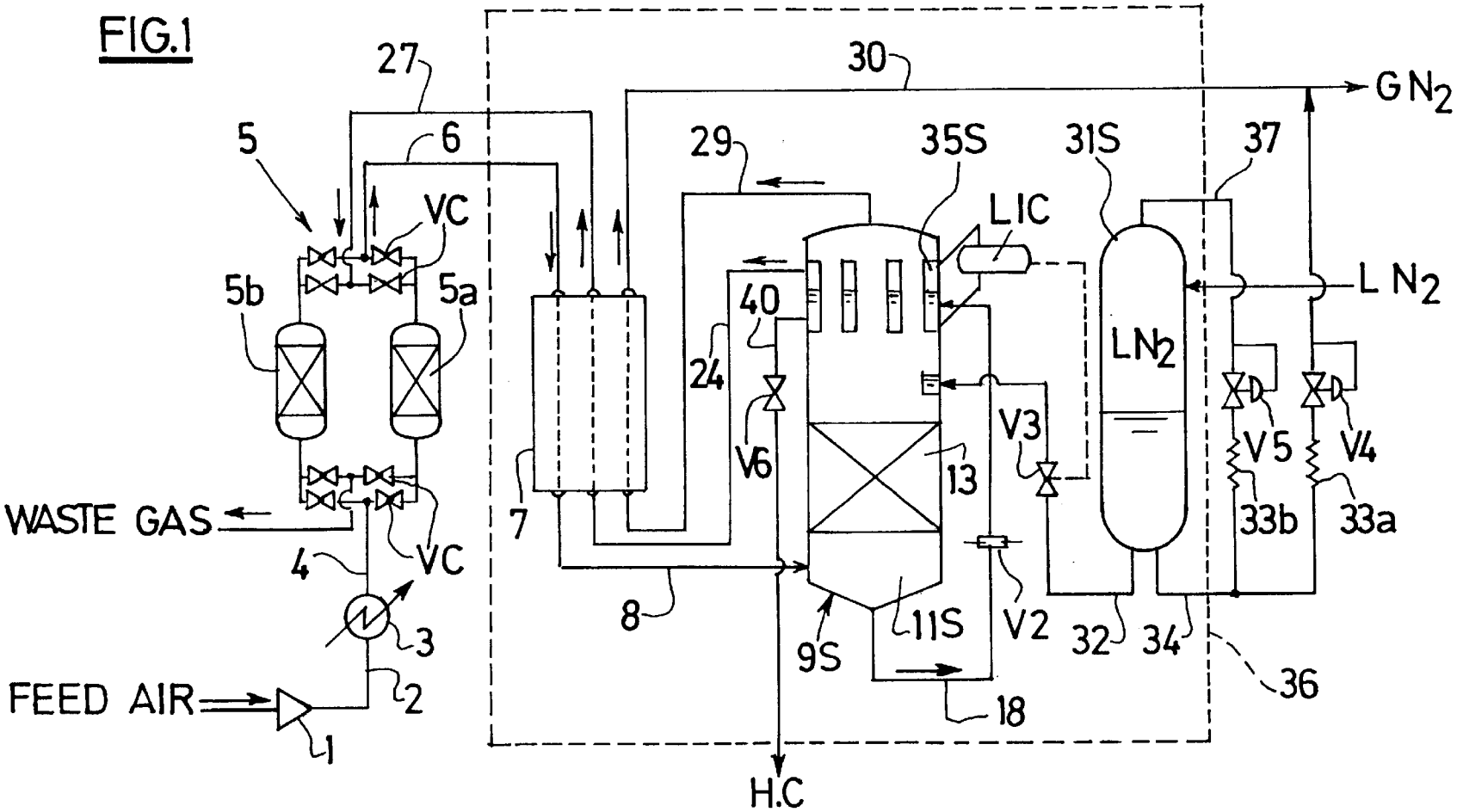
FIG. 1 is a schematic structural view showing one example of the air distillation apparatus according to the first embodiment.

After air is passed through a filter (not shown) and compressed in a compressor 1 to 9 kg/cm$^2$G as shown in FIG. 1, it is introduced to a Freon refrigerator 3 through a pipe 2, previously cooled down to about 5° C. by said refrigerator 3, and then introduced to one adsorbing column 5*a* of a prepurifier 5 through a pipe 4. In this one adsorbing column 5*a,* the compressed feed air is freed of carbon dioxide and moisture therein (the removal of hydrocarbons is enabled depending on the apparatus), and it is then introduced to a main heat exchanger 7 through a pipe 6. At that time, the regeneration of another adsorbing column 5*b* of said prepurifier 5 will be effected by waste gas introduced here through a pipe 27, as mentioned below, where the switch-over of both the adsorbing columns 5*a,* 5*b* will be conducted by a switch-over valve VC.

The feed air introduced in the main heat exchanger 7 is brought in heat exchange with nitrogen gas and waste gas, which will be hereinafter described, so as to be cooled down nearly to its liquefying point. Then, the cooled feed air is introduced to the lower space 11S of a rectification column 9S through a pipe 8 and caused to rise here.

To the upper part of a rectifying portion 13 of the rectification column 9S, on the other hand, liquid nitrogen is introduced, as mentioned below, where a gas which has risen through said rectification column 9S is liquefied in a condenser 35S, and the liquefied gas is permitted to flow down as a reflux liquid through the rectifying portion 13 so as to be rectified through gas-liquid contact with the rising gas, whereby oxygen-enriched liquefied air (an oxygen-enriched component) is produced and caused to flow down to the lower part of said rectification column 9S and nitrogen gas (a nitrogen component) is separated through rectification to the top thereof.

The oxygen-enriched liquefied air produced and caused to flow down to the bottom of said rectification column 9S is sucked into a pipe 18 together with a small amount of air (i.e. with air in an amount less than two times the volume of the oxygen-enriched liquefied air, and preferably in an amount less than 10%), without being stored in the bottom of said rectification column 9S, and expanded to about 1.9 kg/cm$^2$G by an orifice V2, and it is then introduced to the cold reserving portion of the condenser 35S. Although a conduit for transporting the oxygen-enriched liquid flowing down from the rectifying portion 13 to the bottom of said rectification column 9S into said condenser 35S as refrigeration, without reserving the oxygen-enriched liquid in the bottom of said rectification column, is composed of the pipe 18 and the orifice V2, said transport route may be composed of a fully opened valve and the pipe 18 itself based on the regulation of pressure loss.

Nitrogen gas in the top of said rectification column 9S is introduced to the main heat exchanger 7 through a pipe 29, and the oxygen-enriched air (waste gas) which has been evaporated by the nitrogen gas of the rectification column 9S, from the oxygen-enriched liquid reserved in the condenser 35S, is introduced into the main heat exchanger 7 through a pipe 24. Then, these nitrogen gas and waste gas are respectively brought in heat exchange with the compressed feed air in the main heat exchanger 7. The nitrogen gas will be taken out as product nitrogen gas (GN2) at ambient temperature at a pressure of about 8.7 kg/cm$^2$G through a pipe 30, and the waste gas will be passed through a pipe 27 so as to attain ambient temperature at a pressure of about 1.7 kg/cm$^2$G, and is sent to the adsorbing column 5*b* of the prepurifier 5, where it will be used as a regeneration gas for the adsorbing column 5*b,* to remove carbon dioxide and moisture therefrom.

All the refrigeration which is required within a cold box 36 containing this rectification column 9S is supplied by liquid nitrogen assist (LN2) introduced from the outside into the liquid nitrogen storage tank 31S and stored here, and this liquid nitrogen will be taken out through a pipe 32 and introduced to the upper part of the rectifying portion 13 of said rectification column 9S, as the opening degree of the valve V3 is controlled by a liquid level indication and control device LIC which is a control means, which maintains the liquid level in the condenser 35S of said rectification column 9S at a set level. A liquid level detection means (not shown) for detecting the height of a liquid level of said oxygen-enriched liquid reserved in the condenser 35S is provided, and the opening degree of the supply valve V3 for said liquid nitrogen is controlled on the basis of an output from said liquid level detection means, so that the liquid level of said oxygen-enriched liquid reserved in said condenser 35S is kept almost at a set level.

In a case where the demand of nitrogen exceeds the producing capacity of the rectification column 9S, liquid nitrogen is led out through a pipe 34 extending from the lower part of the liquid nitrogen storage tank 31S and evaporated in an evaporator 33*a,* and the evaporated nitrogen is introduced to a pipe 30 after its pressure is regulated to about 8.5 kg/cm$^2$G by a valve V4.

In addition, a pipe 37 branched from the pipe 34 has an evaporator 33*b* and a pressure regulation valve V5 inserted therein, and it is returned to the top of the liquid nitrogen storage tank 31S to maintain the pressure of the liquid nitrogen storage tank 31S at a predetermined pressure.

A pipe 40 and a valve V6 are optionally provided in order to discharge the oxygen-enriched liquid in the condenser 35S, whereby a part or all of such oxygen-enriched liquid can be discharged when hydrocarbons are concentrated in the oxygen-enriched liquid, because of a succession of the operation of the unit.

In addition, the cold box 36 shown by a dotted line is an insulated vessel accommodating the main heat exchanger 7, rectification column 9S and liquid nitrogen storage tank 31 S, which constitute low-temperature equipment.

Figure 2:
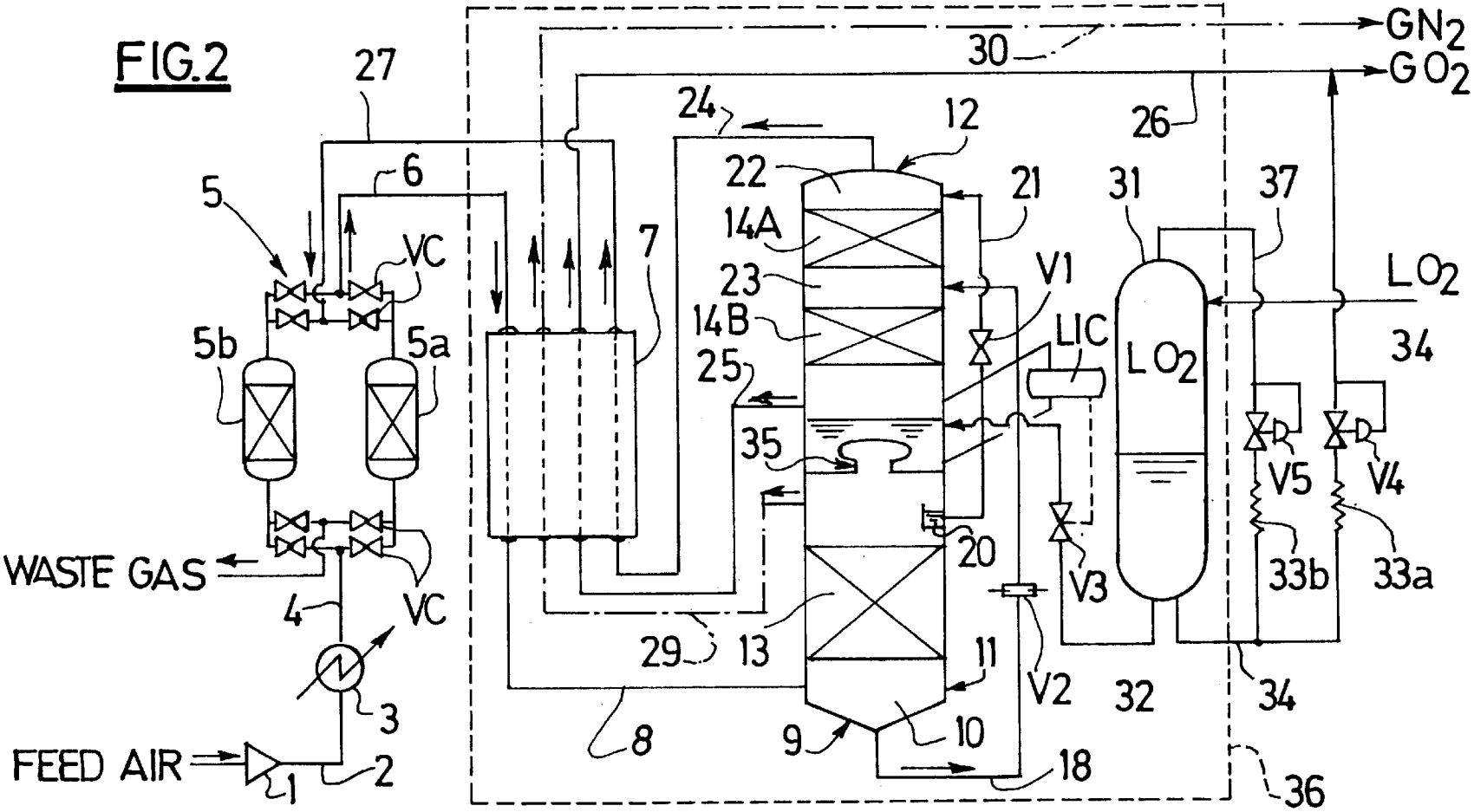
FIG. 2 is a schematic structural view showing one example of the air distillation apparatus according to the second embodiment.

After air in the atmospheric air passed through a filter (not shown) is taken in a compressor 1 and compressed to 9 kg/cm$^2$G by said compressor 1 as shown in FIG. 2, it is introduced to a Freon refrigerator 3 through a pipe 2, previously cooled down to about 5° C. by said refrigerator 3, and then introduced to an adsorbing column 5*a* of a prepurifier 5 through a pipe 4. In this adsorbing column 5*a,* the compressed feed air is freed of carbon dioxide and moisture (the removal of hydrocarbons is enabled depending on the apparatus), and it is then introduced to a main heat exchanger 7 through a pipe 6. At that time, the regeneration of another adsorbing column 5*b* of said prepurifier 5 will be effected by waste gas introduced here through a pipe 27, as mentioned below.

The feed air introduced in the main heat exchanger 7 is brought in heat exchange with oxygen gas, nitrogen gas and waste gas, which will be hereinafter described, so as to be cooled down nearly to its liquefying point. Then, the cooled feed air is introduced to the lower space 10 of a medium-pressure rectification column 11 of a duplex rectification column 9 through a pipe 8 and caused to rise here.

To the bottom of a low-pressure rectification column 12 of said duplex rectification column 9, on the other hand, liquid oxygen is introduced from a liquid oxygen storage tank 31, fed by an outside source, through a pipe 32 and a pressure reduction valve V3, into the main condenser 35 where a gas (a nitrogen component) which has risen through said medium-pressure rectification column 11 is liquefied in a main condenser 35, and the liquefied gas is permitted to flow down as a reflux liquid through a rectifying portion 13 thereof so as to be rectified through gas-liquid contact with the rising gas, whereby oxygen-enriched liquefied air (an oxygen-enriched component) is produced and caused to flow down to the lower part of said medium-pressure rectification column 11 and nitrogen gas is separated through rectification to the top thereof.

The oxygen-enriched liquefied air (the oxygen-enriched component) produced and caused to flow down to the bottom of said medium-pressure rectification column 11 is sucked into a pipe 18 together with a small amount of air (i.e. with air in an amount less than two times the volume of the oxygen-enriched liquefied air, and preferably in an amount less than 10%), without being reserved in the bottom of said medium-pressure rectification column 11, and expanded to about 1.9 kg/cm$^2$G by an orifice V2, and it is then introduced to a space 23 between the first upper rectifying portion 14A and the second upper rectifying portion 14B of the low-pressure rectification column 12. Namely, a transport route for leading the oxygen-enriched component from the bottom of said medium-pressure rectification column 11 to said low-pressure rectification column 12 is composed of the pipe 18 and the orifice V2, and used as a transport route for transporting the oxygen-enriched liquid flowing down to said bottom, without reserving the oxygen-enriched liquid in the same bottom. But, said transport route may be composed of a fully opened valve and the pipe 18 itself based on the regulation of pressure loss, similarly to the first embodiment.

At the top of said medium-pressure rectification column 11 is reserved the nitrogen gas which is rectified through the rectifying portion 13 of the medium-pressure rectification column 11 and rises here. A part of the nitrogen gas is liquefied in the main condenser 35 and a part of the liquefied nitrogen is caused to flow down through the medium-pressure rectification column 13 as a reflux liquid. This reflux liquid is rectified through gas-liquid contact with air rising in the medium-pressure rectification column 13. On the other hand, the remaining part of the liquid nitrogen is reserved in a liquid nitrogen reserving portion 20 of said medium-pressure rectification column 11, and it is passed through a pipe 21 and expanded to about 1.8 kg/cm$^2$G at an expansion valve V1, and then led to an upper space 22 of the first upper rectifying portion 14A of the low-pressure rectification column 12.

Waste gas (a nitrogen component) in the top of said low-pressure rectification column 12 is introduced to the main heat exchanger 7 through a pipe 24, and oxygen gas evaporated by the nitrogen gas of the medium-pressure rectification column 11, of liquid oxygen (cold) reserved in the main condenser 35 in the bottom of the low-pressure rectification column 12, is introduced into the main heat exchanger 7 through a pipe 25. Then, this oxygen gas and waste gas are respectively brought in heat exchange with the compressed feed air in the main heat exchanger 7. The oxygen gas will be taken out as product oxygen gas (GO2) at ambient temperature at a pressure of about 2 kg/cm$^2$G through a pipe 26, and the waste gas will be passed through a pipe 27 so as to reach ambient temperature at a pressure of about 1.8 kg/cm$^2$G, and sent to the adsorbing column 5*b* of the prepurifier 5 where it will be used as a regeneration gas for the adsorbing column 5*b,* as mentioned above, to take out carbon dioxide and moisture therefrom.

In a case where nitrogen is required at the same time, nitrogen gas is taken out at a pressure of about 8.7 kg/cm$^2$G from the upper part of the rectifying portion 13 of said medium-pressure rectification column 11 through a pipe 19 and brought in heat exchange with the feed air in the main heat exchanger 7. Then, it will be taken out as product nitrogen gas (GN2) at ambient temperature through a pipe 30.

All the refrigerator which is required in a cold box 36 including this duplex rectification column 9 is supplied by liquid oxygen (LO2) introduced from the outside into the liquid oxygen storage tank 31 and reserved here, and this liquid oxygen will be taken out through a pipe 32 and introduced to the bottom of the low-pressure rectification column 12, as the opening degree of the valve V3 is controlled by a liquid level indication and control device LIC which maintains the liquid level at the bottom of said low-pressure rectification column 12 at a set level. Namely, a liquid level detection means (not shown) for detecting the height of a liquid level of said liquid reserved in the condenser 35 is provided, and the opening degree of the supply valve V3 for said liquid oxygen is controlled on the basis of an output from said liquid level detection means, so that the liquid level of said liquid reserved in said condenser is kept almost at a set level.

Where the demand of oxygen exceeds the producing capacity of the duplex rectification column 9, furthermore, liquid oxygen is led out through a pipe 34 extending from the lower part of the liquid oxygen storage tank 31 and evaporated in an evaporator 33*a,* and the evaporated oxygen is introduced to a pipe 26 after its pressure is regulated to a pressure of 2 kg/cm$^2$G by a valve V4.

In addition, a pipe 37 branched from the pipe 34 has an evaporator 33*b* and a pressure regulation valve V5 inserted therein, and it is returned to the top of the liquid oxygen storage tank 31 to maintain the pressure of the liquid oxygen storage tank 31 at a predetermined pressure.

Figure 3:
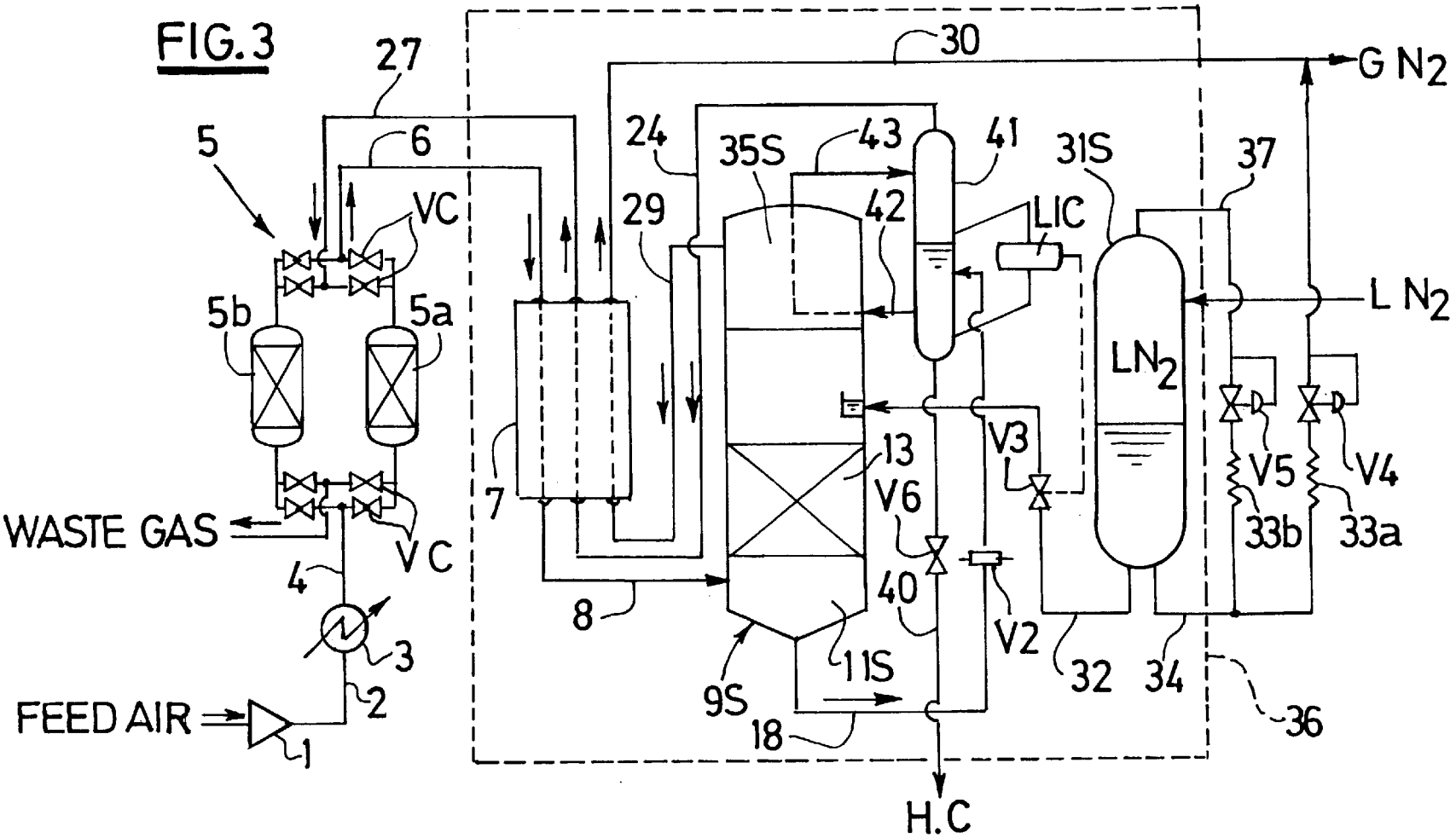
FIG. 3 is a schematic structural view showing one example of the air distillation apparatus according to the third embodiment.

In the embodiment of FIG. 3, a column similar to that of FIG. 1 is used. The oxygen-enriched liquefied air which has been generated and caused to flow down to the bottom of said rectification column 9S is sucked together with a small amount of air (i.e. together with air in an amount smaller than the amount that is twice the volume of the oxygen-enriched liquefied air, and preferably in an amount smaller than 10%) into a pipe 18, while not stored in the bottom of said rectification column. Then, the oxygen-enriched liquefied air is expanded to about 1.9 kg/cm$^2$G by an orifice V2, and thereafter introduced into a phase separator 41. Namely, a transfer route for transferring the oxygen-enriched liquid which flows down from the rectifying portion 13 to the bottom of said rectification column 9S into said phase separator without storing said liquid in the bottom of said rectification column, is composed of the pipe 18 and the orifice V2. The transfer route may be composed of a fully opened valve or the pipe 18 itself under a pressure loss regulation, with no use of a control valve as a controlling valve. In this case, in addition, there will be satisfactorily selected an orifice or valve having an aperture optimum for this unit.

Nitrogen gas in the top of the rectification column 9S in all amount is passed through one path of a condenser 35S, where a part of the nitrogen gas is condensed and caused to flow down as a reflux liquid and the remaining part thereof is introduced into the main heat exchanger 7 through a pipe 29. After the oxygen-enriched liquid which has been supplied from the phase separator 41 and passed through another path of said condenser 35S is given heat by the nitrogen gas of the rectification column 9S so as to get a gas-liquid mixed oxygen-enriched liquid, it is introduced into the phase separator 41 and subjected to gas-liquid separation, and the thus-discharged oxygen-enriched air (waste gas) is introduced into the main heat exchanger 7 through a pipe 24.

Then, these nitrogen gas and waste gas are respectively exchanged in heat with the compressed feed air in the main heat exchanger 7. The nitrogen gas will be taken out through a pipe 30 under a pressure of about 8.7 kg/cm$^2$G as a nitrogen gas product (GN2) having a normal temperature, and the waste gas will be passed through a pipe 27 so as to have a normal temperature under a pressure of about 1.7 kg/cm$^2$G, and sent to an adsorption column 5*b* of the prepurifier 5 to be regenerated, where it will be used as a regeneration gas for the adsorption column 5*b* to take out carbon dioxide and moisture therefrom, as mentioned above.

The phase separator 41 serves to supply liquid to said condenser 35S in an amount dependent on the height of the liquid level thereof. For instance, the condenser 35S and phase separator 41 are connected in communication with each other by a pipe 42 so that the liquid level in the condenser 35S is made almost equal to the liquid level in the gas-liquid separator 41. In this case, there are adopted various types of carrying out an indirect cooling in the heat exchange as the type of said condenser 35S, and there are exemplified, for instance, a shell-and-tube type or an aluminum brazing type. And, as to the type of said gas-liquid separator 41, there are adopted various types of utilizing a mass difference between gas and liquid, and there is used, for example, a storage tank having a gas discharge port in its upper portion and a liquid discharge port in its lower portion.

All the cold required in a cold reserving box 36 including this rectification column 9S will be supplemented by liquid nitrogen (LN2) introduced from the outside in a liquid nitrogen storage tank 31S and stored therein. This liquid nitrogen is taken out through a pipe 32 and introduced to above the rectifying portion 13 of said rectification column 9S, while the opening degree of a supply valve V3 is regulated by a liquid level indicator controller LIC, which is a control means, so that the liquid level of said phase separator 41 is kept at a set liquid level. Namely, a liquid level detection means (not shown) is provided for detecting the height of a liquid level of said oxygen-enriched liquid stored in the gas-liquid separator 41 and the opening degree of the supply valve V3 for said liquid nitrogen is controlled on the basis of an output from said liquid level detection means so that the liquid level of said oxygen-enriched liquid stored in said gas-liquid separator 41 is kept almost at a set liquid level.

Other embodiments will now be described.

Although an example has been described where the condenser is arranged in the rectification column, said condenser may be arranged outside of the column.

According to the present invention, a LN2 supply valve V3 is controlled on the basis of the liquid level of a condenser 35S, and setting and controlling the aperture of a gas and liquid air supply orifice so that the liquid level in the bottom of a rectification column 9S always becomes zero (this is the method of the present invention).

The following steps (1) to (7) take place (1) Liquid level of a condenser 35S lowers, (2) Valve V3 is opened, (3) Inflow of LN2 increases, (4) Increased reflux liquid flows down, (5) Liquid air supply quantity increases, (6) Liquid level of the condenser 35S rises, and (7) Cold balance.

Figure 4:
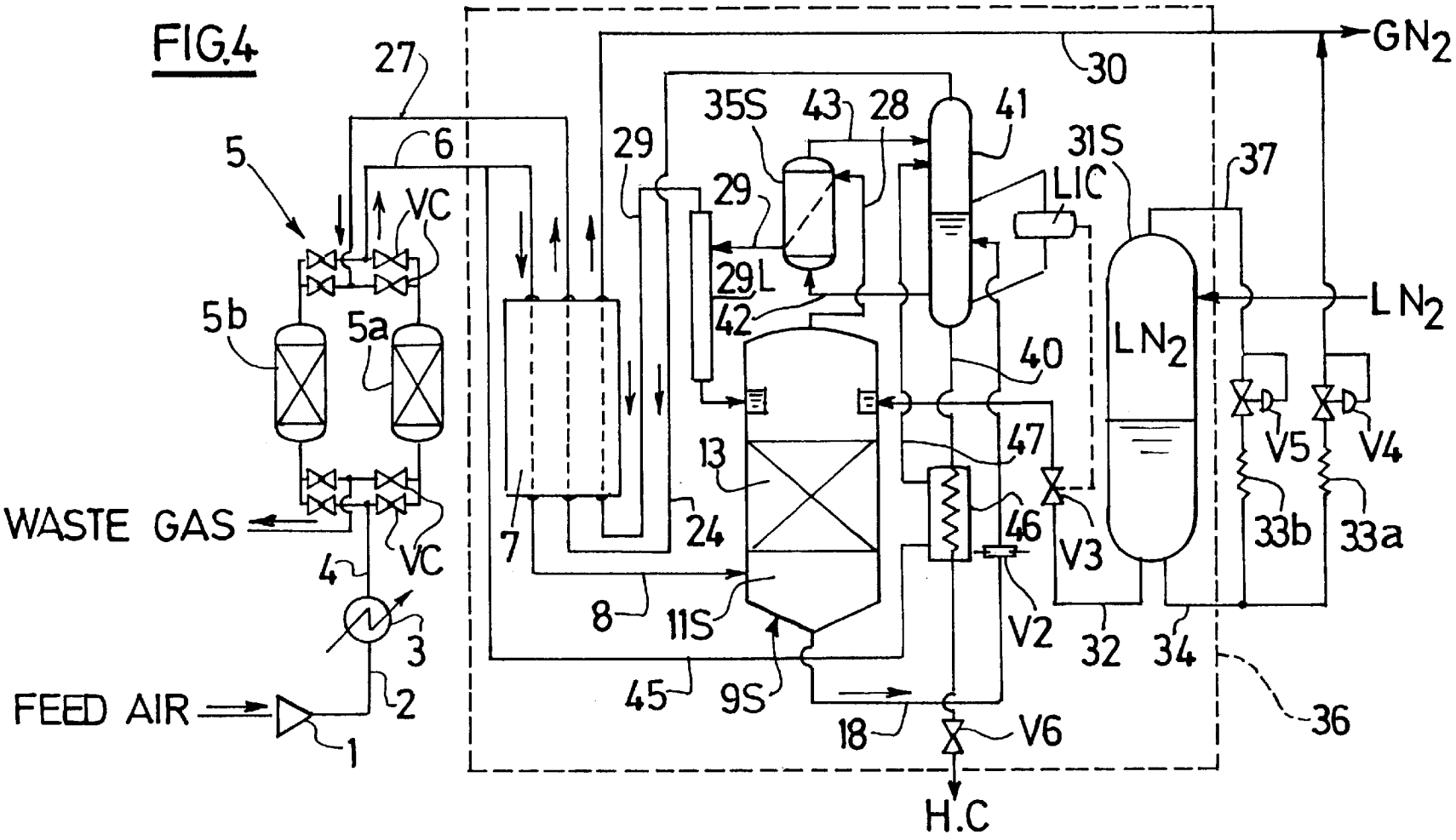
FIG. 4 is a schematic structural view showing one example of the air distillation apparatus according to the fourth embodiment.

FIG. 4 shows a further embodiment similar to that of FIG. 3. Only the different points between both the embodiments will be described here.

Outside and above a rectification column 9S is disposed a condenser 35S, and all amount of nitrogen gas which is destined to be a product is led out of the top of the rectification column 9S to the condenser 35S through a pipe 28. The nitrogen gas is cooled down by the cold of an oxygen-enriched liquid supplied from a phase separator 41 and reduced in pressure, so as to be partially liquefied, and a resulting gas-liquid mixture is led out thereof through a pipe 29. A pipe 29L as a vertical portion of the pipe 29 is made so thick that gas and liquid can be separated in its upper portion and in its lower portion. The liquid obtained by gas-liquid separation here will be returned to the rectification column 9S as a reflux liquid and the gas also obtained will be introduced into a main heat exchanger 7 as a product.

Another heat exchanger 46 is provided for recovering the cold (waste cold) of a hydrocarbons-enriched liquid on its discharge, where a part of feed air introduced therein through a pipe 45 is exchanged in heat with said hydrocarbons-enriched liquid so as to be cooled down, and then introduced into the gas-liquid separator 41 through a pipe 47, and thus the cold of said hydrocarbons-enriched liquid is recovered.

Although an example has been described where the control means comprises an LIC made as one body with the liquid level detection means, in the aforementioned embodiments, said control means may be made separately from the liquid level detection means.

Temperature and pressure referred in the aforementioned descriptions are merely exemplified when the present invention is put into practice. Accordingly, said temperature and pressure are not limited to these aforementioned figures because they vary, depending on the design of the respective unit and parts or the operating condition.

Although an example has been described where the liquefied product storage tank is arranged in the cold reserving casing having the rectification column arranged therein, said liquefied product storage tank may be arranged outside of the cold reserving casing housing the rectification column. In this case, said storage tank is perhaps arranged in another cold reserving casing.

The bottom of the rectification column has been made in a reverse conical form in order that the oxygen-enriched liquid flowing down to the same bottom is permitted to flow easily towards the pipe, there may be provided, for further enhancing the fluidity of the oxygen-enriched liquid, guide grooves capable of forming flow passages within the reverse conical portion.

What is claimed is:

1. An air distillation unit comprising:

a main heat exchanger for cooling compressed and purified feed air;

a rectification column for separating cooled feed air into a nitrogen-enriched gas and an oxygen-enriched liquid;

a condenser for at least partially condensing nitrogen-enriched gas to provide a reflux liquid;

a tank for storing cryogenic liquid from an external source, and means for sending cryogenic liquid from said storage tank to said column or said condenser;

means for removing oxygen-enriched liquid from the bottom of said column; and wherein said bottom is structured and arranged to discharge said oxygen-enriched liquid without storing said oxygen-enriched liquid in the bottom of said column.

2. A unit as claimed in claim 1, further comprising means for sending said oxygen-enriched liquid to said condenser, and wherein the cryogenic liquid is nitrogen, the amount of nitrogen sent to the column being controlled in dependence on the liquid level in the condenser.

3. A unit as claimed in claim 1, further comprising means for sending said oxygen-enriched liquid to a phase separator to form a gas and a liquid, said liquid being sent from said phase separator to said condenser, said cryogenic liquid being nitrogen sent to said column and the amount of nitrogen sent to the column being controlled in dependence on the liquid level in the phase separator.

4. A unit as claimed in claim 1, wherein said column is a medium-pressure column thermally linked via said condenser to a low pressure column and said oxygen-enriched liquid is sent to said low-pressure column.

5. A unit as claimed in claim 4, wherein said cryogenic liquid is oxygen sent to said condenser and the amount of oxygen sent to said condenser is controlled in dependence on the liquid level of the condenser.

6. A unit as claimed in claim 1, wherein said column has a conical bottom.

7. An air distillation method comprising:

cooling compressed feed air;

sending feed air to a rectification column;

at least partially condensing nitrogen-enriched gas at the top of said column;

removing oxygen-enriched liquid from the bottom of said column;

adding cryogenic liquid from an external source to said condenser or said column; and wherein said oxygen-enriched liquid is discharged from the bottom of the column without being stored in the bottom of said column.

8. A method as claimed in claim 7, further comprising sending said oxygen-enriched liquid to said condenser, sending nitrogen as said cryogenic liquid to said column and controlling the amount of liquid nitrogen sent to the column in dependence on the liquid level in the condenser.

9. A method as claimed in claim 7, further comprising sending said oxygen-enriched liquid to a phase separator and then to said condenser, sending nitrogen as said cryogenic liquid to said column and controlling the amount of liquid nitrogen sent to the column in dependence on the liquid level in the condenser.

10. A method as claimed in claim 7, wherein said column is a medium-pressure column thermally linked via said condenser to a low-pressure column, comprising sending oxygen-enriched liquid to said low pressure column, sending oxygen as said cryogenic liquid to said condenser, and controlling the amount of oxygen sent to said condenser in dependence on said liquid level in said condenser.

* * * * *